US010189040B2

(12) United States Patent
Vecchione

(10) Patent No.: US 10,189,040 B2
(45) Date of Patent: Jan. 29, 2019

(54) DISPENSING DEVICE

(71) Applicant: Stephanie Vecchione, Oreland, PA (US)

(72) Inventor: Stephanie Vecchione, Oreland, PA (US)

( * ) Notice: Subject to any disclaimer, the term of this patent is extended or adjusted under 35 U.S.C. 154(b) by 0 days.

(21) Appl. No.: 15/157,502

(22) Filed: May 18, 2016

(65) Prior Publication Data

US 2017/0028419 A1 Feb. 2, 2017

Related U.S. Application Data

(60) Provisional application No. 62/198,265, filed on Jul. 29, 2015.

(51) Int. Cl.
*B05B 11/00* (2006.01)

(52) U.S. Cl.
CPC ..... *B05B 11/3047* (2013.01); *B05B 11/0089* (2013.01); *B05B 11/3094* (2013.01)

(58) Field of Classification Search
CPC ..... B05B 11/3047; B05B 11/3094; B05B 11/0089
See application file for complete search history.

(56) References Cited

U.S. PATENT DOCUMENTS 3,877,616 A * 4/1975 Stevens ..... B05B 11/3001 222/321.9
4,033,487 A * 7/1977 Micallef ..... B05B 11/3029 222/207
4,157,774 A * 6/1979 Micallef ..... F04B 43/0063 222/321.9
4,470,526 A * 9/1984 Cha ..... B67D 1/0456 222/320
4,473,097 A * 9/1984 Knickerbocker .. B65D 81/3211 141/113
4,762,241 A * 8/1988 Lang ..... B65D 1/06 215/250
4,903,718 A * 2/1990 Sullivan ..... A61C 17/036 134/184
4,930,664 A * 6/1990 Ellison ..... B05B 9/0805 141/18
5,366,119 A * 11/1994 Kline ..... B05B 11/0037 222/180
5,421,488 A * 6/1995 Ehrbar ..... B65D 1/06 215/2

(Continued)

*Primary Examiner* — Frederick C Nicolas
(74) *Attorney, Agent, or Firm* — Global Intellectual Property Agency, LLC; Daniel Boudwin

(57) ABSTRACT

A fillable dispensing device for use in fully dispensing a substance stored therein. The dispensing device includes a container having an upper end, a lower end, and a hollow interior volume. The upper end includes a hand-pump mechanism thereon that includes a plunger and a tubular straw that extends into the interior volume of the container, wherein operation of the plunger draws the substance through the straw and out from an opening on the plunger. The lower end of the container includes a dispensing aperture that can be used to dispense any remaining substance from the container when the container is nearly empty. The dispensing aperture is removably covered by a panel. Further, the container includes a valve for allowing a user to add additional substances to the contents of the dispensing device.

10 Claims, 3 Drawing Sheets

(56) References Cited

U.S. PATENT DOCUMENTS

| | | | | |
|---|---|---|---|---|
| 5,482,172 | A * | 1/1996 | Braddock | B65D 1/06 215/237 |
| 6,923,343 | B1 * | 8/2005 | Erxleben | B05B 11/3045 215/219 |
| 7,815,077 | B2 | 10/2010 | Yang et al. | |
| 7,861,893 | B2 * | 1/2011 | Voegele | B05C 17/00553 222/137 |
| 8,225,967 | B2 * | 7/2012 | Dodd | B05B 1/3026 222/321.8 |
| 8,348,107 | B2 * | 1/2013 | Succar | B65D 47/2018 222/209 |
| 8,413,854 | B2 * | 4/2013 | Py | G01F 11/021 141/311 R |
| 8,528,789 | B2 * | 9/2013 | Ramsey | A45C 11/24 222/182 |
| 2003/0056850 | A1 * | 3/2003 | Lee | B41J 2/17506 141/18 |
| 2004/0118477 | A1 * | 6/2004 | Desmond | A61J 1/067 141/18 |
| 2006/0102654 | A1 | 5/2006 | Seys et al. | |
| 2008/0302831 | A1 | 12/2008 | Wang | |
| 2009/0242588 | A1 | 10/2009 | Olson | |
| 2011/0240678 | A1 | 10/2011 | Keller et al. | |
| 2012/0090730 | A1 * | 4/2012 | Dumont | A45D 34/02 141/2 |

* cited by examiner

DISPENSING DEVICE

CROSS REFERENCE TO RELATED APPLICATION

This application claims the benefit of U.S. Provisional Application No. 62/198,265 filed on Jul. 29, 2015. The above identified patent application is herein incorporated by reference in its entirety to provide continuity of disclosure.

BACKGROUND OF THE INVENTION

Field of the Invention

The present invention relates to dispensing devices. More specifically, the present invention provides a dispensing device for liquid soap, shampoo, and the like wherein the dispensing device comprises a flexible container having a hand-pump dispensing mechanism on an upper end thereof, a dispensing aperture on a lower end thereof, and a refill valve for allowing a user to deposit additional substances into the container.

Hand pump containers are often utilized to dispense any of various liquid or gel substances, such as hand soap, hand sanitizer, shampoo, or conditioner, among others. People may utilize a single dispensing container and refill the container when it is empty. However, refilling the container can be difficult and messy as the user must remove the dispensing mechanism, and must further remove the tubular straw that extends into the container. The dispensing mechanism may still be coated with a substance and may drip or spill. Further, the user must then attempt to fill the container through the opening on which the dispenser was located, which may be narrow and difficult to access. Thus, a dual dispensing container that can be easily filled is desired.

Devices have been disclosed in the prior art that relate to containers having multiple dispensing mechanisms. These include devices that have been patented and published in patent application publications. These devices generally relate to containers having a hand pump mechanism in addition to alternate dispensing means, such as U.S. Published Patent Application Number 2011/0240678, U.S. Published Patent Application Number 2006/0102654, U.S. Published Patent Application Number 2009/0242588, U.S. Pat. No. 7,815,077, and U.S. Published Patent Application Number 2008/0302831.

These prior art devices have several known drawbacks. The devices in the prior art provide containers with multiple dispensers thereon. However, these devices fail to disclose a container having filling valve thereon for easily refilling the container or for depositing additional substances into the container.

In light of the devices disclosed in the prior art, it is submitted that the present invention substantially diverges in design elements from the prior art and consequently it is clear that there is a need in the art for an improvement to existing dispensing devices. In this regard the instant invention substantially fulfills these needs.

SUMMARY OF THE INVENTION

In view of the foregoing disadvantages inherent in the known types of dispensing devices now present in the prior art, the present invention provides a new dispensing device wherein the same can be utilized for providing convenience for the user when dispensing a substance from a container.

The dispensing device comprises a container having an upper end and a lower end, and a hollow interior volume for storing a substance, such as liquid soap. The upper end includes a hand pump mechanism thereon that includes a plunger and a tubular straw that extends into the interior volume of the container, wherein actuation of the plunger causes the substance to be drawn through the straw and dispensed via an opening on the plunger. The lower end of the container includes a dispensing aperture thereon that is removably covered by a panel that prevents the substance from escaping from the dispensing opening until the panel is removed by the user. The container further includes a filling valve on an upper end thereof for easily filling the container with substance, wherein the filling opening is removably sealed via a plug.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
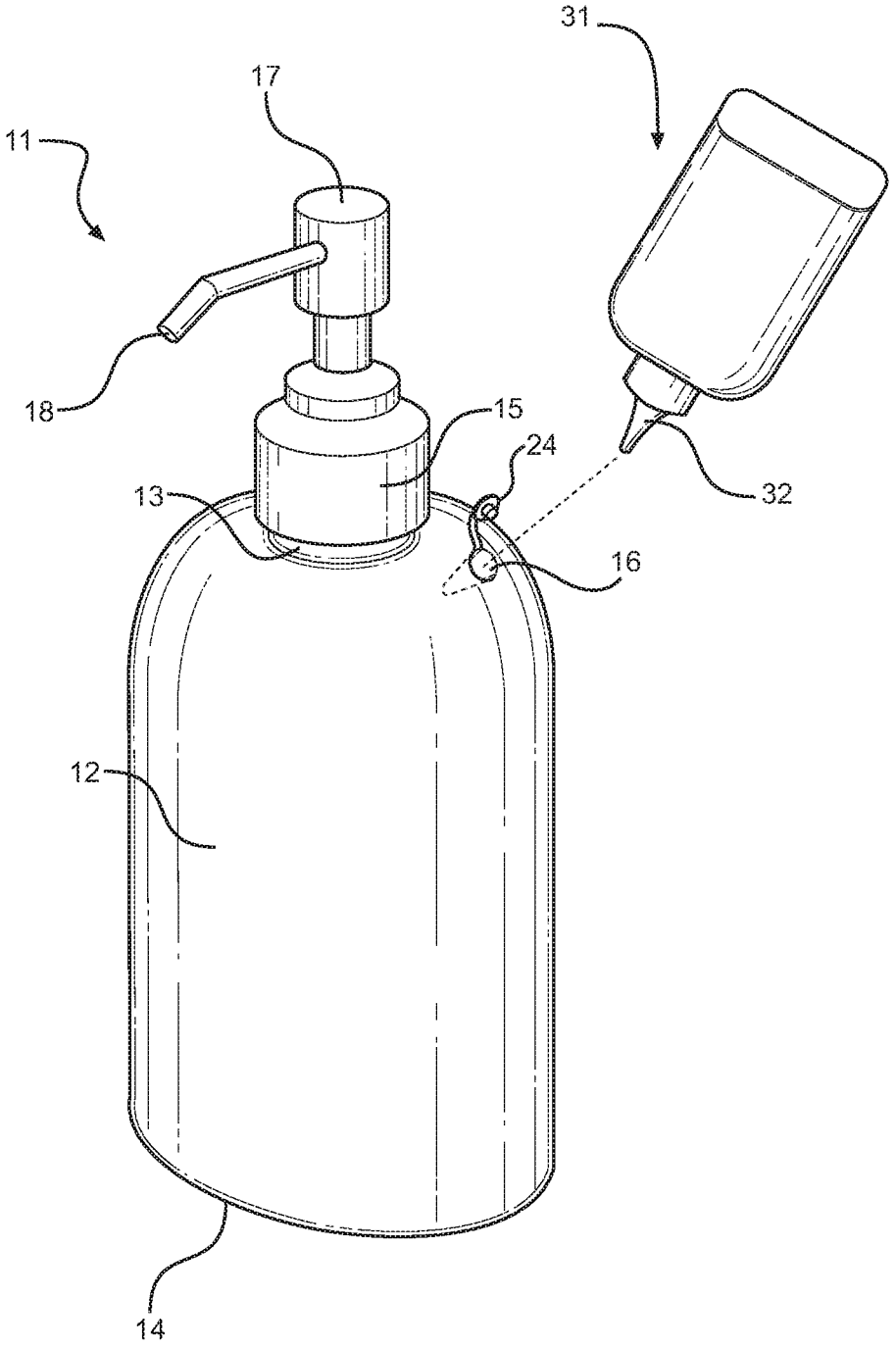
FIG. 1 shows a perspective view of the dispensing device.

Reference is made herein to the attached drawings. Like reference numerals are used throughout the drawings to depict like or similar elements of the dispensing device. For the purposes of presenting a brief and clear description of the present invention, the preferred embodiment will be discussed as used for dispensing a substance, such as liquid soap or shampoo, and the like. The figures are intended for representative purposes only and should not be considered to be limiting in any respect.

Referring now to FIG. 1, there is shown a perspective view of the dispensing device. The dispensing device 11 comprises a container 12 having an upper end 13, a lower end 14, and a hollow interior volume. The container 12 can have any of various configurations. The container 12 is preferably composed of a semi-rigid material, such as high density polyethylene, so that the container 12 can be squeezed by the user and will then return to its original configuration.

The upper end 13 of the container 12 includes a hand-pump mechanism 15 thereon. The hand-pump mechanism 15 is adapted to dispense the substance stored within the container 12. The hand pump mechanism 15 is preferably permanently secured to the upper end 13 of the container 12. The hand pump mechanism 15 includes a tubular straw that extends into the interior volume of the container, and a plunger 17 having an opening 18 thereon. When the plunger 17 is depressed, the substance is drawn through the tubular straw and is dispensed via the opening 18 on the plunger 17.

The container 12 further comprises a filling valve 16 thereon. The valve 16 allows a user to fill the container 12 with a substance without having to remove the hand pump mechanism 15 from the container 12. The valve 16 preferably includes a plug 24 removably positioned thereon for removably sealing the valve 16. The plug 24 helps to prevent the substance from escaping from the interior volume of the container 12. The valve 16 is preferably positioned on an upper end of the container 12 and extends into the interior volume of the container so as to allow substance to be poured downwardly into the filling opening 16. The valve 16 is used to infuse the contents of the container 12 with an oil, fragrance, or other similar substance. A pouch 31 having a conical tip 32 is shown as used for inserting a substance through the valve 16 and into the container 12. However, various types of pouches, bottles, and the like can be used to fill the container 12.

Figure 2:
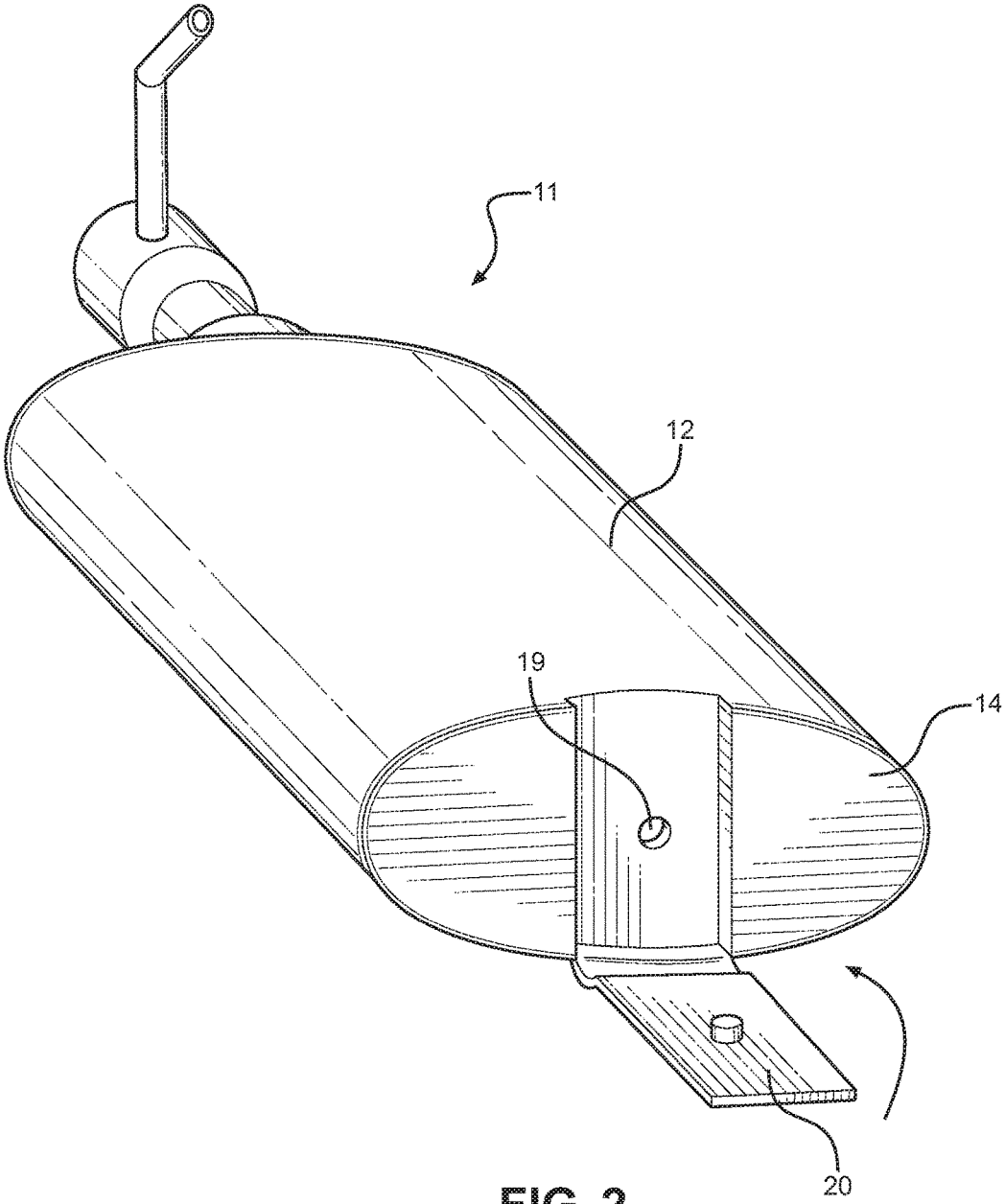
FIG. 2 shows a perspective view of the underside of the dispensing device.

Referring now to FIG. 2, there is shown a perspective view of the underside of the dispensing device. The lower end 14 of the container 12 comprises a dispensing aperture 19 thereon. The dispensing aperture 19 is preferably centrally positioned on the lower end 14 of the container 12. The dispensing aperture 19 is removably covered by a panel 20 disposed on the lower end 14 of the container 12. The panel 20 removably covers the dispensing aperture 19 so as to prevent substance from escaping therefrom when the container 12 is not in use. To withdraw a substance from the container 12, the user can remove the panel 20 and can squeeze the container 12 so that the substance therein is forced through the dispensing aperture 19. This allows the user to dispense the remaining substance within the container when the level within the container is too low to allow the substance to be dispensed via the hand pump mechanism.

Figure 3:
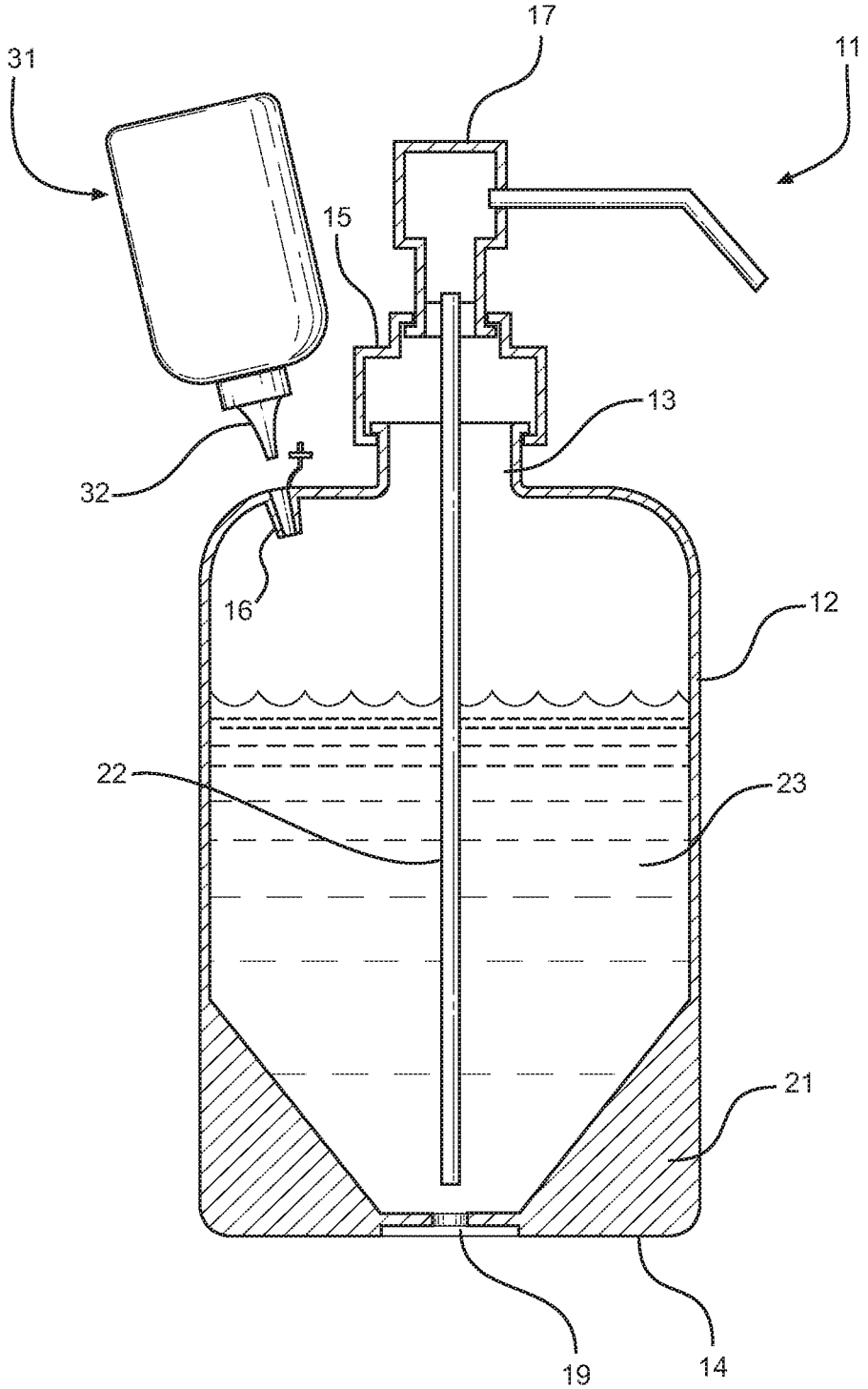
FIG. 3 shows a side cross sectional view of the dispensing device.

Referring now to FIG. 3, there is shown a side cross sectional view of the dispensing device. The dispensing device 11 comprises a container 12 having a hollow interior volume 23. The hollow interior volume 23 is adapted to be filled with a substance, such as liquid soap, hand sanitizer, shampoo, conditioner, or the like. The hand-pump mechanism 15 is disposed on the upper end 13 of the container 12. The hand pump mechanism 15 comprises a plunger 17 that can be actuated in order to dispense the substance within the container 12. The hand-pump mechanism 15 further includes a tubular straw that extends into the interior volume of the container 23, wherein the tubular straw draws the substance therethrough for dispensing when the plunger is actuated.

The interior volume 23 of the container 12 is configured to slope towards the dispensing aperture 19 at the lower end 14 of the container 12. The interior volume of the container 23 includes a sloped member 21 on the lower end thereof that serves to funnel or direct the substance within the container to the dispensing aperture. In this way, the container can be fully emptied in order to ensure that all of the substance is used and little or no waste results due to substance remaining in the container.

The container 12 comprises a refill valve 16 on an upper end 13 thereof that is adapted to receive a substance, such as an oil therethrough. The refill valve 16 is preferably a one-way valve so as to allow for insertion of substances into the container 12 but so as to prevent the substance from escaping the container 12 through the refill valve 16. The refill valve 16 preferably extends from the outer surface of the container 12 into the interior volume thereof so that the container 12 retains a continuous exterior surface. In operation, the user can obtain a pouch 31 having an oil or other substance therein and can align the tip or nozzle 32 of the pouch 31 with the refill valve 16. The user can then squeeze or pour the oil into the valve 16 and into the container 12. The user can then seal the valve 16 using a plug thereon so as to prevent any leakage.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispensing device, comprising:

a container having an upper end, a lower end, and a hollow interior volume;

a hand pump mechanism disposed on the upper end for dispensing a substance stored within the interior volume, wherein the hand pump mechanism is permanently secured to the upper end of the container;

a dispensing aperture on the lower end, wherein the dispensing aperture is removably sealed by a removable panel;

a refill valve disposed on the container.

2. The dispensing device of claim 1, wherein the container is composed of a semi-rigid material such that the container can be squeezed in order to cause the substance to escape the container via the dispensing aperture.

3. The dispensing device of claim 1, wherein the hand pump mechanism comprises a tubular straw that extends into the interior volume of the container; a plunger for drawing the substance into the straw and for dispensing the substance through a nozzle in fluid communication with the tubular straw.

4. The dispensing device of claim 1, wherein the removable panel is pivotally affixed to the lower end of the container.

5. The dispensing device of claim 1, further comprising a fixed sloped member disposed within the interior volume of the container at the lower end thereof, wherein the sloped member is adapted to direct the substance towards the dispensing aperture.

6. The dispensing device of claim 1, wherein the refill valve is a one-way valve configured to allow the user to insert a substance into the container.

7. The dispensing device of claim 6, wherein the refill valve is configured to receive a nozzle therein.

8. The dispensing device of claim 1, wherein the refill valve includes a plug removably securable thereon for sealing the valve.

9. The dispensing device of claim 1, wherein the removable panel is configured to align flush with the lower end of the container.

10. The dispensing device of claim 1, wherein the removably panel comprises a surface area less than the surface area of the lower end of the container.

* * * * *